United States Patent [19]

Berglund

[11] Patent Number: 4,609,506

[45] Date of Patent: Sep. 2, 1986

[54] THROTTLED FLUID MIXING DEVICE

[75] Inventor: Bengt Berglund, Forel/Lavaux, Switzerland

[73] Assignee: Spiro Investment A.G., Boesingen, Switzerland

[21] Appl. No.: 694,754

[22] PCT Filed: May 25, 1984

[86] PCT No.: PCT/GB84/00186

§ 371 Date: Jan. 25, 1985

§ 102(e) Date: Jan. 25, 1985

[87] PCT Pub. No.: WO84/04798

PCT Pub. Date: Dec. 6, 1984

[30] Foreign Application Priority Data

May 26, 1983 [GB] United Kingdom ..... 8314622

[51] Int. Cl.[4] ..... F02M 7/22

[52] U.S. Cl. ..... 261/44 A; 261/44 D; 137/98; 137/894

[58] Field of Search ..... 261/44 A, 44 D; 137/98, 137/894

[56] References Cited

U.S. PATENT DOCUMENTS

| | | | |
|---|---|---|---|
| 1,097,787 | 5/1914 | Brewer et al. | 261/44 D |
| 1,179,663 | 4/1916 | Shakespear, Jr. et al. | 261/44 D |
| 1,398,707 | 11/1921 | Tarkington | 261/44 D |
| 1,600,294 | 9/1926 | Nice | 261/44 D |
| 2,009,102 | 7/1935 | Bern | 137/98 |
| 2,311,061 | 2/1943 | Lutherer | 137/98 |
| 2,578,543 | 12/1951 | Harr | 137/894 |
| 3,054,603 | 9/1962 | Rogers | 261/50 A |
| 3,106,494 | 10/1963 | Thorsheim | 137/98 |
| 3,116,348 | 12/1963 | Walker | 261/44 D |
| 3,352,167 | 11/1967 | Winters . | |
| 3,647,002 | 3/1972 | Lindsay | 137/98 |
| 3,671,025 | 6/1972 | Elliott | 261/76 |
| 4,161,935 | 7/1979 | Eckert et al. | 261/44 D |

FOREIGN PATENT DOCUMENTS

| | | | |
|---|---|---|---|
| 7165 | 1/1980 | European Pat. Off. . | |
| 2058992 | 6/1972 | Fed. Rep. of Germany . | |
| 2746622 | 4/1979 | Fed. Rep. of Germany | 261/44 A |
| 787446 | 9/1935 | France . | |

*Primary Examiner*—Tim Miles

*Attorney, Agent, or Firm*—Sherman and Shalloway

[57] ABSTRACT

Fluid mixing valve means comprising valves in first and second fluid conduits having specific configurations, means coupling said valves for common movement and means coupling the output of said second fluid conduit to said first fluid conduit on the downstream side of said first valve.

10 Claims, 2 Drawing Figures

THROTTLED FLUID MIXING DEVICE

Figure 1:
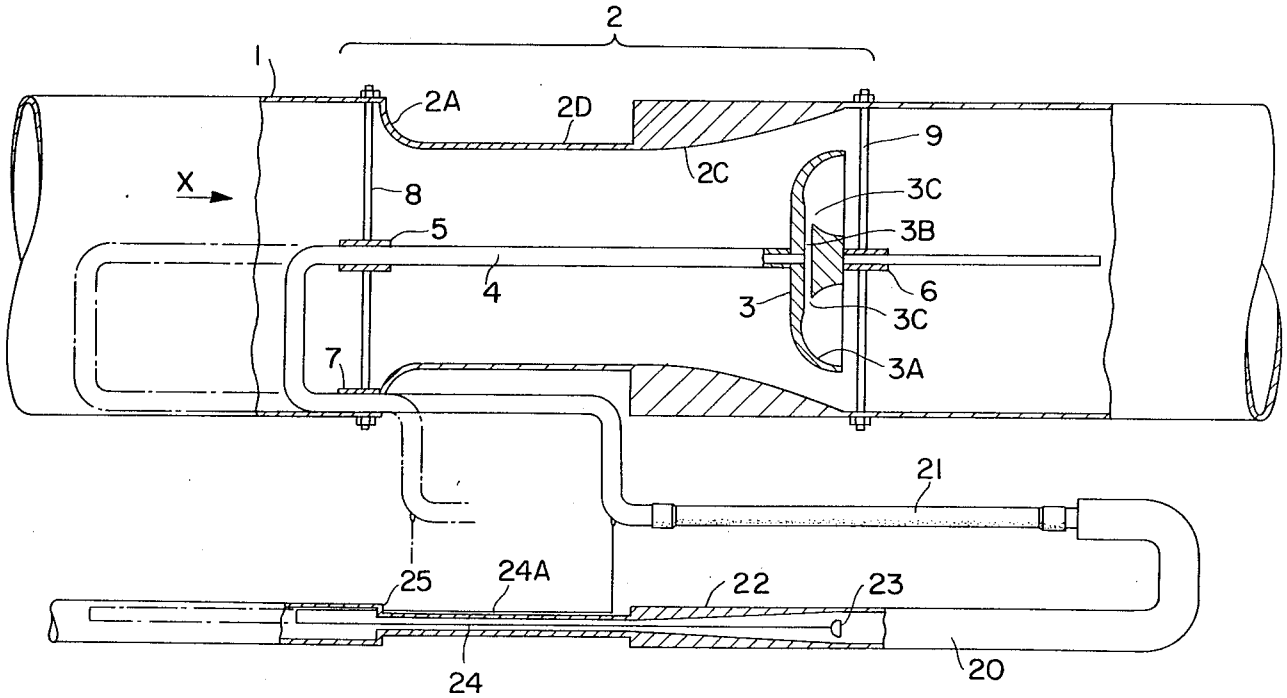

This invention concerns improvements in and relating to throttled fluid mixing devices, and more especially to a device intended for mixing a first fluid, of which the rate of flow through a duct is to be controlled, with a second fluid to be introduced in to the first fluid flowing in said duct.

A wide variety of such mixing devices has been proposed for various reasons, including the mixing of liquid or gaseous fuels to be mixed with combustion air to be supplied to a burner, or for use as the carburettor of or fuel injection device of an internal combustion engine.

Known devices of the above-mentioned type have the disadvantage that the throttling of the flow of the first fluid can only be controlled approximately within a given range, as the performance of known kinds of throttling device cannot be accurately predicted in advance and must be determined by experiment. Thus, accurate control of the relative proportions of the two fluids to be mixed, whilst at the same time controlling the throttling of the primary fluid flowing in the ducting becomes extremely difficult and complicated, to the extent that the optimum fluid mixture for any given purpose cannot be obtained under all conditions of flow of the primary fluid through the throttle valve.

It is accordingly an object of the present invention to provide a combined throttle valve and fluid mixing device, which both achieves effective mixing of primary and secondary fluids and also enables throttling of the flow of the primary fluid in a predictable manner.

In accordance with the present invention there is provided a device for mixing a first fluid, of which the rate of flow through a duct is to be controlled, with a second fluid to be introduced into the first fluid whilst flowing in said duct, said device comprising an axially extending valve casing having an upstream end and a downstream end for connection respectively into the duct intended to convey said first fluid, and containing a disc-shaped valve member located axially within said casing and arranged for axial movement relatively to a flared inner wall portion of said casing located between said upstream and downstream ends and arranged to widen continuously in a direction away from said upstream end and towards said downstream end, whereby, in use, said valve member serves to throttle the flow of said first fluid, and means, coupled to said disc-shaped valve member, for introducing said second fluid into said valve casing at a point or points located immediately on the downstream side of said valve member, whereby the turbulent flow of said first fluid in the region immediately downstream of the valve member is effective to cause mixing of the two fluids.

It is a further and preferred object of the invention to provide a mixing device wherein the throttling of the flow of the first fluid can be achieved in such a manner that there is a predetermined mathematical relationship between the position of the disc-shaped valve member and the flow of said first fluid within the ducting. This can be achieved with a suitable construction of the disc-shaped valve member, and an appropriate shaping of the flared portion of the valve casing, as has been described in prior published European Patent Specification No. 0 007 165.

Figure 2:
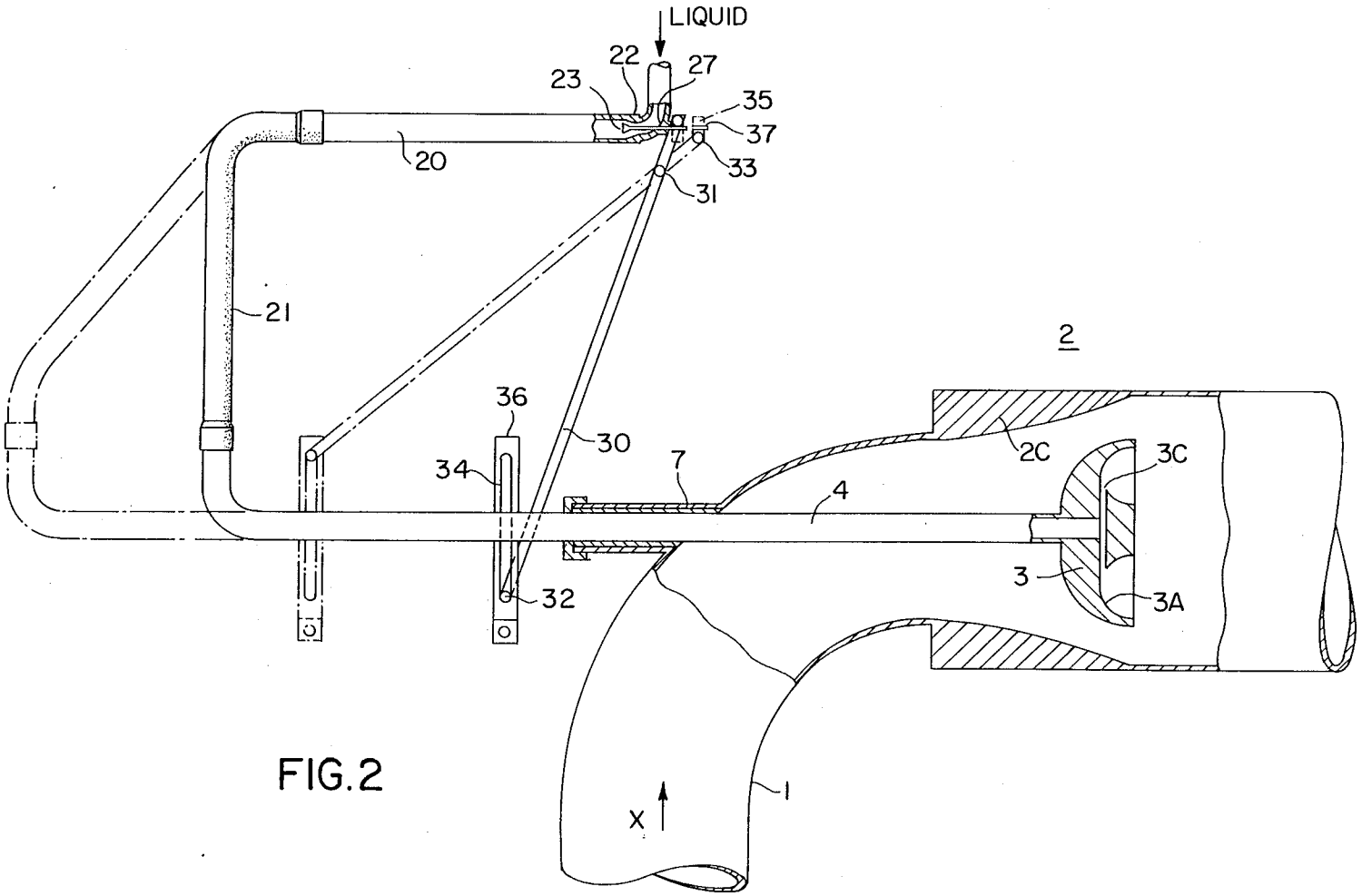

Further preferred features and advantages of the invention will become apparent from the following description with reference to the accompanying drawings, in which:

FIG. 1 is a sectional elevation of a fluid mixing valve in accordance with the invention, and FIG. 2 is a view similar to FIG. 1 of another arrangement according to the invention.

Referring to FIG. 1, the reference numeral 1 indicates a run of ducting within which air is arranged to flow in the direction of the arrow X. Incorporated within the ducting 1 is an air flow control valve of which the casing is indicated generally at 2, and which comprises an upstream end 2A and a downstream end 2B respectively arranged for connection into the run of ducting 1. Between the upstream and downstream ends of the valve casing there is a flared wall portion 2C which widens continously outwards in a direction away from the upstream end and towards the downstream end of the casing. The portion 2C is defined by a removable hollow conical member which may be interchangeable for the purpose described below. A valve member 3 is arranged coaxially within the flared wall portion 2C, and is mounted for axial movement relatively to the flared portion of the casing upon a shaft 4. The shaft 4 is axially slidable in sleeves 5 to 7 mounted upon spiders 8 and 9 attached within the upstream end and downstream ends of the valve casing respectively. As shown the shaft 4 extends to the outside of the valve casing 2, and in order to enable a seal to be maintained between the inside and the outside of the valve casing, whilst allowing axial movement of the shaft 4, the latter is formed in a U-shaped configuration of which the respective limbs are guided in the sleeves 5 and 7 located upon the spider 8, the valve casing 2 having a portion 2D of reduced diameter corresponding to the diameter of the inlet end of the flared wall portion 2C, so that the outer limb of the U-shaped portion of the shaft 4 can extend axially along the outside of the valve casing, the sleeve 7 passing through the valve casing and serving to form a seal between the wall of the casing and the shaft 4.

The valve member 3 has a domed or radiused front face and a semi-circular annular recess 3A at its rear surface, in order to promote the flow of eddy currents in the fluid at the rear side of the valve member 3. The portion of the shaft member 4 extending from the exterior of the valve casing to the valve member 3 is formed as a hollow tubular conduit through which liquid may be supplied to a transverse passageway 3B of the valve member 3, the passageway 3B terminating in orifices 3C from which the liquid may discharge into the eddy currents flowing in the recess 3A at the rear side of the valve member 3 and thus become mixed with the fluid flowing through the value device. Liquid may be supplied to the movable shaft 4 from a fixed conduit 20 which is coupled to the shaft 4 by way of a bellows or light coupling 21, which permits relative movement between the shaft 4 and conduit 20 whilst maintaining a sealed passageway for the liquid to be conducted. In order to enable metering of the flow of liquid to the shaft 4 in accordance with the volume of fluid flow through the valve device, the conduit 20 may itself incorporate a tapered valve section 22 with respect to which a circular member 23 may be axially moved by means of a shaft 24 which serves a function similar to that of the shaft 4 of the main valve, and has an extension 24A extending axially through a sealed aperture 25 in the conduit 20 and directly mechanically coupled to the shaft 4.

It will be appreciated that the device shown in the drawing may be utilised for the mixing of gases, liquids or gas/liquid mixtures, in a variety of circumstances, the response of one or both of the valve devices being compensated in the manner described in European Patent Specification No. 0 007 165.

The fact that the section 2C of the valve casing is constructed as a relatively easily interchangeable insert enables the charcteristics of the valve to be readily adapted to any required conditions wherein a given pressure drop, or a given set of pressure drops, will occur across the valve in use, in accordance with the degree of opening thereof. This pressure drop need not necessarily be the result of the provision of a pressure source at the upstream side of the valve, but might, for example, be due to the existence of a reduced pressure on the downstream side of the valve, the inlet to the valve being at atmospheric pressure. Moreover, the pressure drop across the system including the valve need not necessarily be constant since the characteristics of the valve in accordance with the invention may be utilised advantageously in any context wherein the drop in fluid pressure across the valve is predictable.

In one arrangement, for example, the upstream end of the duct 1 may be coupled to an air supply fan, whilst the upstream end of the conduit 20 is coupled to a liquid supply pump, the delivery pressures of the fan and the liquid supply pump being suited to the characteristics of the respective valves whereby the desired fluid mixture is obtained.

FIG. 2 shows a modified arrangement, wherein the function of the mixing valve is effectively the same as that described in FIG. 1, but the mechanical arrangement has been modified to simplify the mounting of the valve member 3 and the mechanical linkages between the valve members 3 and 23. In FIG. 2, like parts are indicated with the same reference numerals as shown in FIG. 1. It will be noted that, as compared with FIG. 1, the duct 1 is in the form of an elbow communicating with the portion 2C of the valve, and the shaft 4 is thus enabled to be linear, the sleeve 7 being arranged at the apex of the elbow in such a manner that it can form the sole support for the shaft 4 carrying the valve member 3. The conduit 20 likewise has an elbow through a sleeve 27 of which the shaft 24 carrying the valve member 23 can slide in like manner to the shaft 4 of the main valve. The shaft 24 is linked mechanically to the shaft 4 by means of a pivoted lever 30 which is pivotable about a fixed pivot 31 and linked at its respective ends to the shafts 4 and 24 via pins 32 and 33 engaging in transverse slots 34 and 35 of mountings 36 and 37 respectively secured to the shafts 4 and 24. The position of the fixed pivot 31 and the corresponding lengths of the lever arms provided by the lever 30 are selected to provide a transmission ratio between the shafts 4 and 24 corresponding to the relative dimensions of the valves provided by the valve member 3 and the portion 2C on the one hand and the valve member 23 and the portion 22 on the other. In comparison with the arrangement of FIG. 1, this enables the axial length of the portion 22 to be reduced so that the proportions of the valve correspond more closely to that of the main valve. It will be appreciated that the position of the valve shown in full lines in the drawing corresponds to its fully open position, whereas with the valve in its fully closed position the mechanical linkage adopts the position shown in broken lines.

I claim:

1. A fluid mixing valve comprising:

a first fluid conduit containing a first valve casing having an inner face that widens outwardly from a fluid inflow end to a fluid outflow end and a first valve member which is convex toward said fluid inflow end, concave toward said fluid outflow end and is linearly axially movable relatively to said casing in order to vary an annular gap between the valve member and the valve casing, the profile of the said inner face of said first valve casing being so shaped that there is a first, predetermined mathematical relationship between the linear displacement of the said first valve member and the drag coefficient of the fluid flow path defined by said first valve member and said first valve casing;

a second fluid conduit containing a second valve casing having an inner face that widens outwardly from a fluid inflow end to a fluid outflow end and a second valve member of a configuration substantially the same as that of said first valve member which is linearly axially movable relatively to said second casing in order to vary an annular gap between the valve member and the valve casing, the profile of the said inner face of said second valve casing being so shaped that there is a second, predetermined mathematical relationship between the linear displacement of the said second valve member and the drag coefficient of the fluid flow path defined by said second valve member and said second valve casing;

means coupling said second fluid conduit to said first fluid conduit whereby a second fluid delivered from said second conduit can enter said first fluid conduit on the downstream side of said first valve member for mixing with a first fluid flowing in said first conduit in a region of turbulence immediately on the downstream side of said first valve member; and means so coupling said first and second valve members for common movement that a predetermined ratio of the two mixed fluids flowing in said first conduit can be maintained regardless of the total volume of flow of the two fluids.

2. A device as claimed in claim 1, characterized in that the inner face (2C) of said first valve casing is so shaped that there is a predetermined mathematical relationship between the axial position of the first valve member (3) and the flow of said first fluid within the ducting.

3. A device as claimed in claim 1, characterized in that the said means coupling said second fluid conduit to said first fluid conduit comprises a hollow shaft (4) upon which said first valve member (3) is mounted for said axial movement, the bore of said shaft being coupled at a downstream end thereof to at least one exit orifice (3C) located in said first valve member (3) on the downstream side thereof, and, at an upstream end thereof, to a source of said second fluid.

4. A device as claimed in claim 3, characterized in that the said hollow shaft (4) is arranged to extend through said first fluid conduit (1) via a shaft seal (7) enabling longitudinal movement thereof, and said second valve (22, 23,) member for controlling the flow of said second fluid through said shaft (4) is provided between said source of said second fluid and the upstream end of said shaft (4).

5. A device as claimed in claim 4, characterized in that said second valve member (22,23) for controlling the flow of said fluid has a control member (24) mechanically coupled to said hollow shaft (4), whereby the flow of said second fluid is controlled in accordance with the axial position of said hollow shaft (4).

6. A device as claimed in claim 5, characterized in that the second valve member (22, 23) for controlling the flow of said second fluid has a configuration generally corresponding to that of the first valve member (2, 3) controlling said first fluid with the relative dimensions of the respective valve members corresponding to the proportions of said first and second fluids to be mixed.

7. A device as claimed in any one of claims 4–6, characterized in that the said hollow shaft (4) carrying said first valve member is of rectilinear configuration and is mounted for sliding movement within a sleeve (7) extending through an elbow of said first valve casing (1) on the upstream side of said first valve casing (2).

8. A device as claimed in any one of claim 1–6, characterized in that said first valve member (3) has, on the downstream side thereof, an annular recess (3A) extending adjacent an outer rim of the first valve member (3), said at least one exit orifice (3C) opening into said annular recess.

9. A device as claimed in claim 8, characterised in that said annular recess (3A) has a semi-circular cross-section 10. A device as claimed in claim 9, characterised in that the face of said valve member (3) on the upstream side is domed or radiused.

* * * * *

UNITED STATES PATENT AND TRADEMARK OFFICE

CERTIFICATE OF CORRECTION

PATENT NO. : 4,609,506

DATED : September 2, 1986

INVENTOR(S) : Bengt Berglund

It is certified that error appears in the above-identified patent and that said Letters Patent is hereby corrected as shown below:

ON THE TITLE PAGE

[30] Foreign Application Priority Data
delete "May 26, 1983",
insert --May 24, 1983--.

IN THE CLAIMS

Claim 5, line 3, (column 5, line 1),
after "said", insert --second--.

Signed and Sealed this

Twenty-fifth Day of November, 1986

*Attest:*

DONALD J. QUIGG

*Attesting Officer* *Commissioner of Patents and Trademarks*